US010711510B2

(12) United States Patent
Niehausmeier et al.

(10) Patent No.: US 10,711,510 B2
(45) Date of Patent: Jul. 14, 2020

(54) FIXATION DEVICE ESPECIALLY FOR GLASS FOLDING DEVICES

(71) Applicant: Solarlux GmbH, Melle (DE)

(72) Inventors: Uwe Niehausmeier, Rödinghausen (DE); Matthias Klaffke, Belm (DE)

(73) Assignee: Solarlux GmbH, Melle (DE)

( * ) Notice: Subject to any disclaimer, the term of this patent is extended or adjusted under 35 U.S.C. 154(b) by 342 days.

(21) Appl. No.: 15/848,458

(22) Filed: Dec. 20, 2017

(65) Prior Publication Data

US 2018/0179795 A1 Jun. 28, 2018

(30) Foreign Application Priority Data

Dec. 23, 2016 (DE) ..... 10 2016 125 655

(51) Int. Cl.

| | |
|---|---|
| ***E06B 3/48*** | (2006.01) |
| ***E05B 65/00*** | (2006.01) |
| ***E05D 15/26*** | (2006.01) |
| ***E05C 7/06*** | (2006.01) |
| ***E05C 19/02*** | (2006.01) |
| ***E06B 3/50*** | (2006.01) |

(52) U.S. Cl.

CPC ..... *E06B 3/481* (2013.01); *E05B 65/0085* (2013.01); *E05C 7/06* (2013.01); *E05C 19/024* (2013.01); *E05D 15/26* (2013.01); *E06B 3/5018* (2013.01); *E05Y 2900/142* (2013.01)

(58) Field of Classification Search

CPC .... E06B 3/481; E06B 3/5018; E05B 65/0085; E05D 15/26; E05C 7/06; E05C 19/024; E05F 7/005; E05F 7/04; E05F 3/20

See application file for complete search history.

(56) References Cited

U.S. PATENT DOCUMENTS

| | | | | |
|---|---|---|---|---|
| 2,618,809 A | | 9/1949 | Rubinoff | |
| 2,953,809 A | * | 9/1960 | Nelson | E05D 15/00 16/402 |
| 3,329,990 A | * | 7/1967 | Johnson, Jr. | E05F 7/005 16/404 |

(Continued)

FOREIGN PATENT DOCUMENTS

| | | |
|---|---|---|
| DE | 102 39 446 | 8/2003 |
| GB | 2513835 | 11/2014 |

*Primary Examiner* — Katherine W Mitchell

*Assistant Examiner* — Abe Massad

(74) *Attorney, Agent, or Firm* — Gudrun E. Huckett

(57) ABSTRACT

A fixation device for limiting a gap between a first construction component and a second construction component relative to which the first construction component is movable has first and second fitting parts attached to the first and second construction components, respectively. The first fitting part has a fixation projection with first end and opposed second end. The first end is pivotable about a fixation axis fixed at the first construction component. The fixation projection is pretensioned so as to pivot the second end away from the first construction component. The second fitting part has a guiding surface and a holding element. Fixation projection and guiding surface interact such that, when the construction parts are moved toward each other, the second end glides along the guiding surface toward the holding element and catches therein. A folding device of construction components is provided with such fixation devices.

9 Claims, 7 Drawing Sheets

(56) References Cited

U.S. PATENT DOCUMENTS

| | | | | | |
|---|---|---|---|---|---|
| 3,351,973 | A | | 11/1967 | Lawrence, Jr. | |
| 3,361,188 | A | * | 1/1968 | Rudnick | E05F 7/005 160/206 |
| 3,907,021 | A | * | 9/1975 | Smith | E05D 15/26 160/118 |
| 3,973,616 | A | * | 8/1976 | Jensen | E05F 7/005 160/199 |
| 5,052,151 | A | * | 10/1991 | Inui | E05D 15/502 292/304 |
| 5,070,926 | A | * | 12/1991 | Behring | E05D 15/26 160/199 |
| 6,487,755 | B1 | | 12/2002 | Caldari | |
| 6,895,636 | B2 | * | 5/2005 | Nussbaum | E05D 5/0238 16/241 |
| 6,920,908 | B2 | * | 7/2005 | Niehausmever | E05D 15/26 160/118 |
| 8,141,299 | B2 | * | 3/2012 | Vetter | E05F 7/005 16/86 B |
| 9,359,806 | B2 | * | 6/2016 | Header | E06B 1/524 |
| 9,695,623 | B2 | * | 7/2017 | Thomas | E05F 15/60 |
| 2010/0012280 | A1 | * | 1/2010 | Hans | E05D 15/26 160/211 |
| 2017/0030122 | A1 | | 2/2017 | Dreisewerd | |

* cited by examiner

FIXATION DEVICE ESPECIALLY FOR GLASS FOLDING DEVICES

BACKGROUND OF THE INVENTION

The invention relates to a fixation device for movable, areal construction components, such as e.g. windows, doors or glass panels, for delimiting a gap between a narrow side of the areal construction component and a corresponding side of a further construction component, relative to which the areal construction component is movable, wherein the fixation device comprises interacting fitting parts on the narrow side of the areal construction component and on the corresponding side of the further construction component.

The invention further relates to a folding device, in particular a glass folding device, comprising at least a chain of areal construction components that are connected to each other and configured as panels which, for opening the folding device, can be folded against each other, wherein each panel is pivotably connected to the neighboring panel within the chain by top and bottom supporting and guiding fittings arranged on the panels, wherein the folding device comprises the afore mentioned fixation device.

In order to achieve, for example, in case of folding walls a uniform, parallel extension of the panel sections of the folding device relative to each other and provide stability under wind loads, the fittings, usually hinges, of which the top and bottom ones additionally are provided with supporting and guiding functions, in practice are often uniformly distributed across the entire panel height. However, the fitting parts which are projecting past the panel sections are perceived as visually disruptive. For example, DE 102 39 446 C1, US 2017/0030122, or U.S. Pat. No. 6,487,755 already disclose so-called hidden hinges which, when the door panel is closed, neither project past the front side nor the rear side and are completely hidden within the door and frame rabbet. Such hinges comprise usually five-axis holding systems, are constructively complex, and have a relatively large size. In order to accommodate them, the panel sections must have a minimum width. Also, in case of windows and glass doors, the frame must be relatively wide in order to ensure the retraction depth of these conventional hidden hinges.

SUMMARY OF THE INVENTION

It is therefore an object of the invention to provide a device with which movable areal construction components in the closed state can be securely held on each other and which can be embodied, even for slim and narrow profiled sections, so as to visually recede. It is also an object of the invention to design a folding device such that it is configured visually pleasing with slim panel sections but still withstands the loads it is subjected to.

According to the invention, this object is solved by a fixation device wherein at least on one of the construction components the fitting part comprises a fixation projection with a free end that is pivotable about a fixation axis that is fixed relative to the areal construction component and is pretensioned away from the construction component, wherein the fitting part at the other construction component comprises a guiding surface and a holding element, wherein the fixation projection and the guiding surface are arranged relative to each other for interaction with each other such that, upon a movement toward each other of the construction component sides supporting the fitting parts, the fixation projection with its free end which is facing away from the fixation axis glides along the guiding surface toward the holding element and catches in the holding element.

In regard to the folding device this is achieved that between the top and bottom supporting and guiding fittings at least one fixation device according to the invention is provided.

Since in case of movable, in particular areal construction components such as windows, doors or the like, a top fitting (hinge) and a bottom fitting (hinge) are capable of absorbing the occurring static weights and also, as needed, tilting loads, the invention provides a fixation device which can be used on movable areal construction components as a supplemental device in order to compensate, for example, wind loads across the height, deformation caused by thermal action, and/or ensure a uniform seal pressure across the entire length. For this purpose, the fixation device comprises two fitting parts that are not connected to each other when the construction component is open, wherein one fitting part is fixedly connected to the movable areal construction component and the other fitting part is fixedly connected to the further construction component. One of the fitting parts has a fixation projection which is preferably embodied as a tab. The fixation projection is fastened so as to be pivotable about a fixation axis that is fixed relative to the areal construction component and pretensioned in a direction away from the construction component. Preferably, this can be embodied by an arrangement with a spring, in particular a spiral spring, and an axle pin. The pivotability and pretension of the fixation projection can however also be realized in case of a one-piece (monolithic) fitting part by areas of the fitting part that are elastically configured in a targeted fashion. The second fitting part of the fixation device must have a guiding surface and a holding element in accordance with the invention. When the construction component sides which are supporting the fitting parts are moving toward each other, the free end of the fixation projection contacts initially the guiding surface of the oppositely positioned fitting part and then glides along it toward the holding element until it catches therein. In this way, when the construction components or the folding device are/is closed, the construction components or panels are fixed relative to each other and stabilized relative to transverse forces without this requiring a permanent connection between the two fitting parts. When the construction components open again, it is thus constructively possible that the fitting parts are automatically released from each other when the fixation projection moves away from the holding element.

Since the fitting parts are not permanently connected to each other but interact with each other only when contacting each other, the fixation device according to the invention cannot only be used in case of connected construction components that are pivotable relative to each other but also, for example, in case of sliding elements. In particular between sliding panels that are arranged in a rail, the fixation device can be used also against wind loads for stabilization of profiled sections.

The holding element preferably comprises a depression into which the free end of the fixation projection can move. The depression of the holding element can also be embodied in a projection which is projecting from a plane that is formed by the guiding surface. Particularly advantageous is a rounded configuration of the depression with a radius that is smaller than the spacing of the free end of the fixation projection from its fixation axis. In this way, on the one hand, easy gliding of the free end of the fixation projection into the depression is ensured and, on the other hand, a reliable catching or hooking action in the predetermined closed position is realized because, when the fitting parts are moving toward each other, the radius of the depression essentially intercepts the path defined by the pivot radius of the free end of the fixation projection and therefore stops the free end from pivoting farther.

Since the fixation projection is pretensioned away from the construction component to which it is fastened, the functional reliability is improved when the fitting part comprises a stop which limits pivoting of the fixation projection in the direction of pretension. In this way, it is ensured that, when the construction components are open, the fixation projection is always in the correct position in order to glide into the fixation position upon closing. Accordingly, a greater pretension can be selected which improves fixation in the closed position. Preferably, the stop is to be arranged such that, when the construction components are open, an opening angle of the fixation projection relative to the narrow side of the construction component of less than 90° is present, preferably of approximately 30° to 40°.

Even though the fixation devices according to the invention can be advantageously employed when, as described above, only one fixation projection is provided at one fitting part and the guiding surface and the holding element are provided on the other fitting part, it is particularly advantageous when each fitting part comprises a fixation projection and a holding element. In this way, movable construction components are not only fixed but also centered when the fitting parts are completely moved toward each other. The fitting part can be designed such for this purpose that in one area the fixation projection is arranged and in a neighboring area the holding element is arranged so that the fixation projection and the holding element are not impairing each other. An expedient construction enables in this way an identical configuration of both fitting parts of the fixation device which then must only be arranged in rotated position relative to each other on oppositely positioned construction components. This reduces the required number of parts as well as storage costs.

Of course, each fitting part of the fixation device according to the invention can comprise not only one fixation projection and/or one holding element but also a plurality of fixation projections and/or a plurality of holding elements.

It is particularly advantageous that glass folding devices, comprising panels that are connected to each other to form a chain and can be folded against each other for opening of the folding device, can be designed to be visually more pleasing, more delicate, and with slim frame sections by using the afore described fixation devices. It is thus possible to absorb the weight of the panels by top and bottom supporting and guiding fittings and still secure even long and tall panels across their entire height reliably on each other in that between the supporting and guiding fittings (the conventional hinges) one or a plurality of fixation devices of the afore described kind are employed in the frame sections. When skillfully arranged, the fixation devices preferably can be located completely within a gap between two neighboring panels of the folding device so that they are not visible from the outer side nor from the inner side of the folding device. This makes it also possible to provide neighboring panels with continuous seals on the inner side and outer side between which the fixation device is arranged. Such an arrangement is variable as regards clearance and has continuous sealing planes which improves thermal insulation properties. Also, the fixation devices are not visible for the observer and this not only has visual advantages but also provides improved protection against burglary.

BRIEF DESCRIPTION OF THE DRAWING

Further advantages and details of the invention result from the claims and an embodiment illustrated in the drawing.

DESCRIPTION OF THE PREFERRED EMBODIMENTS

Figure 1:
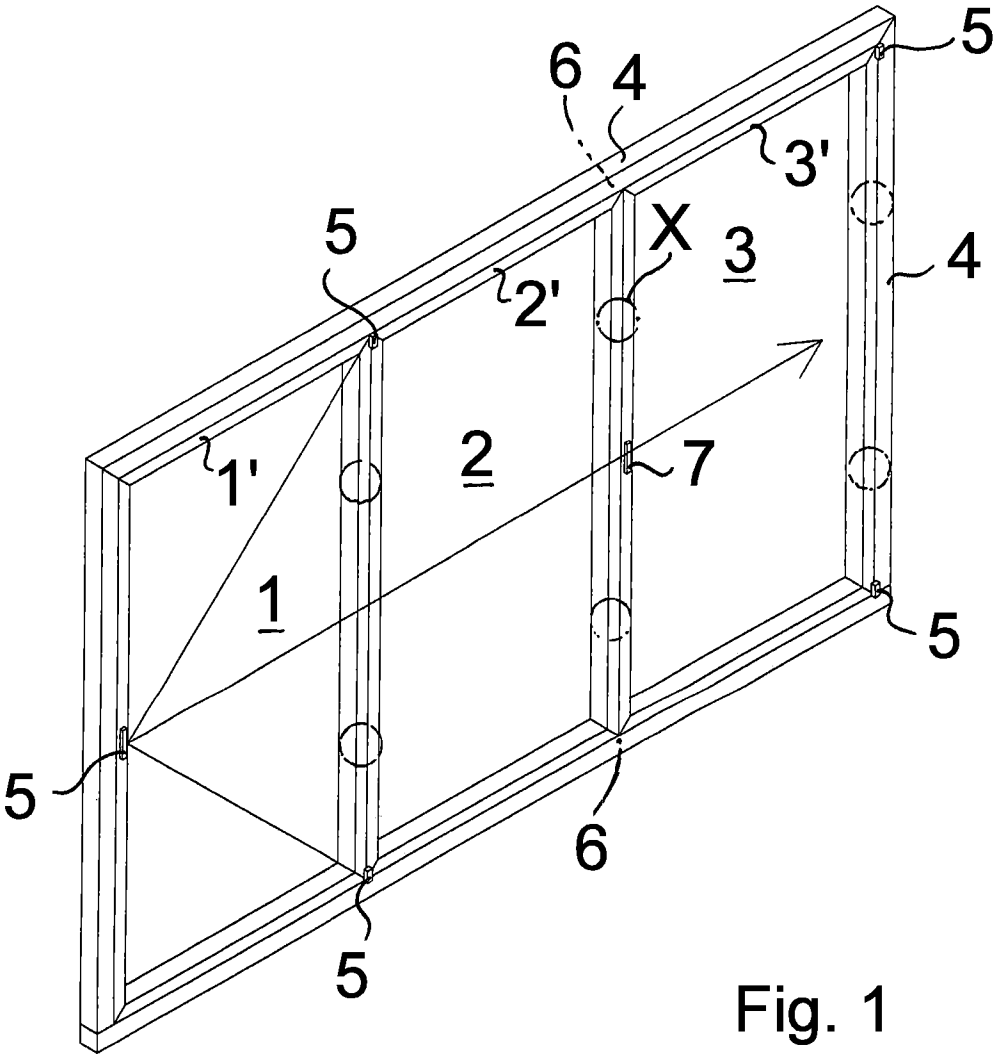
FIG. 1 shows schematically a three-panel folding device in the closed position.
Figure 2:
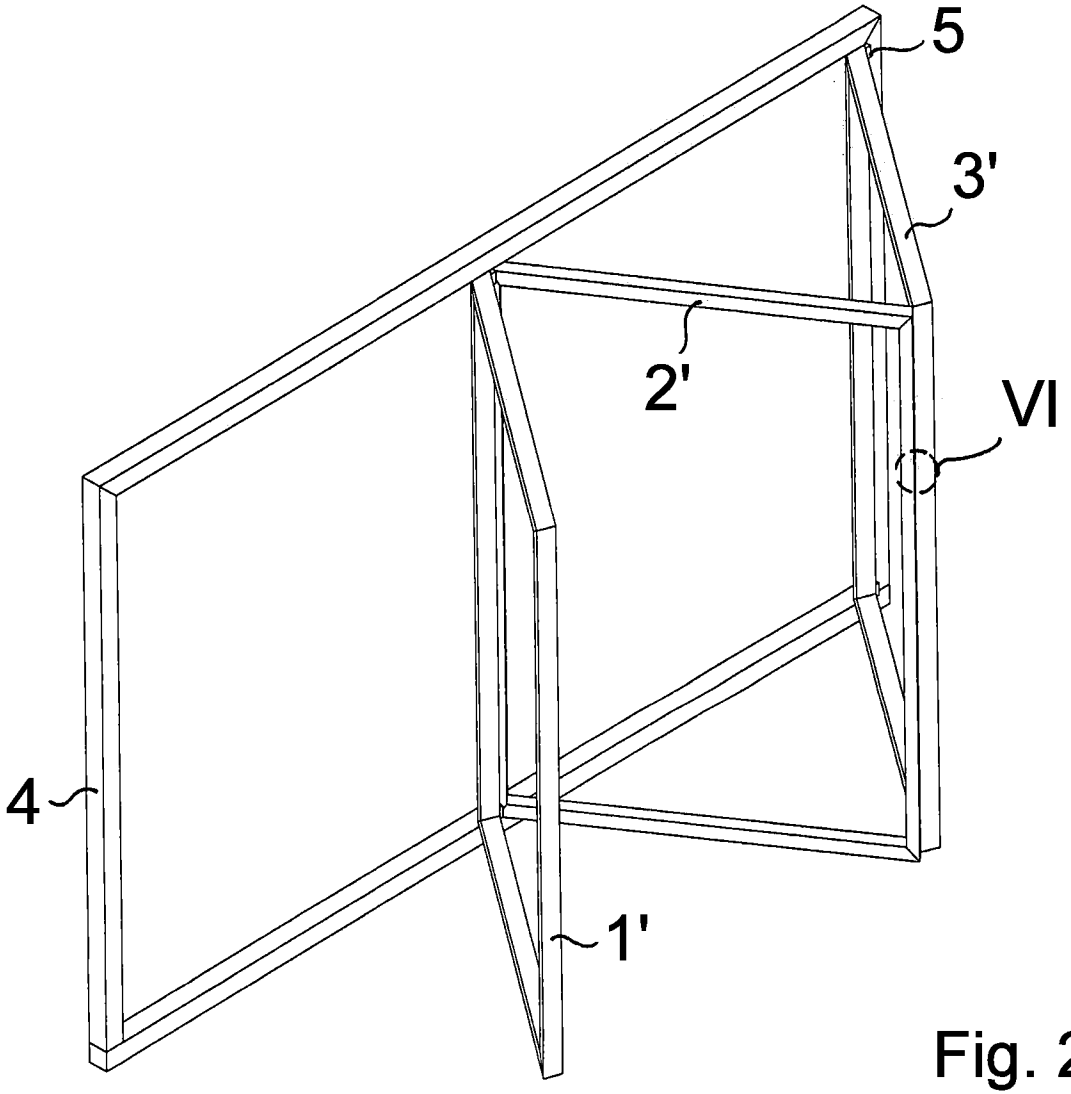
FIG. 2 shows the folding device of FIG. 1 in a partially open position.
Figure 3:
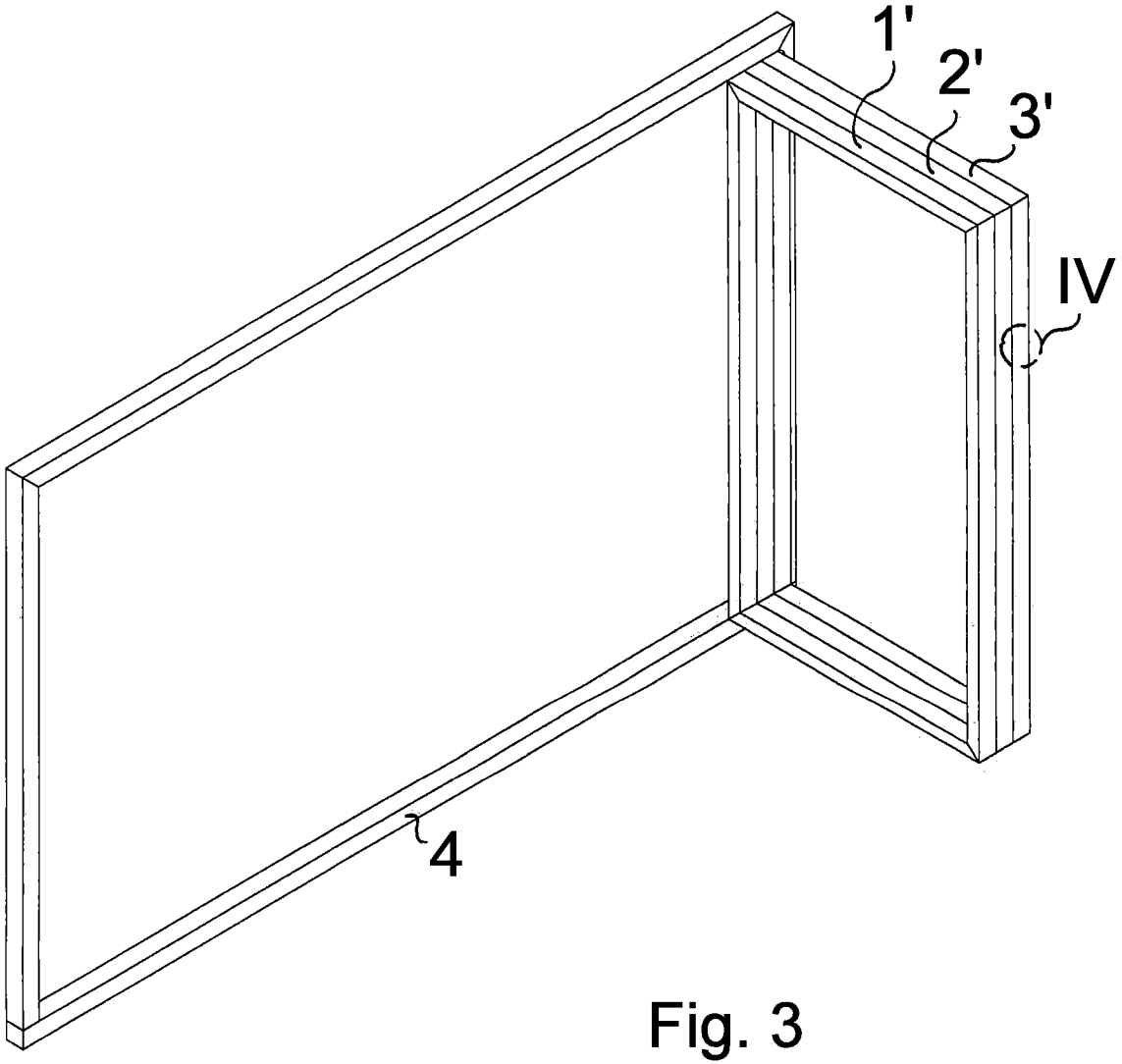
FIG. 3 shows the folding device of FIG. 1 in the completely open position.

The folding device illustrated in FIG. 1 comprises a chain of three areal construction components 1, 2, 3 which are embodied here as glass panels with narrow frame sections 1', 2', 3'. The panels 1, 2, 3 are guided on an outer frame 4 by means of supporting and guiding fittings 5, 6 in a pivotable and partially slidable way. The inner supporting and guiding fittings 5 are visible in FIG. 1 while the outer supporting and guiding fitting 6 are not visible when viewed from the inner side of the folding device shown in FIG. 1 so that the reference numeral 6 only indicates their position. The folding device comprises locking grips 7. The arrow indicates the opening direction of the folding device. When opening the folding device, the panels 1, 2, 3 move past the position of FIG. 2 to the completely open position of the folding device as shown in FIG. 3. Fixation devices can be located, for example, at the positions indicated by circles and one such fixation device will be explained in more detail in the following in connection with the additional Figures.

Figure 5:
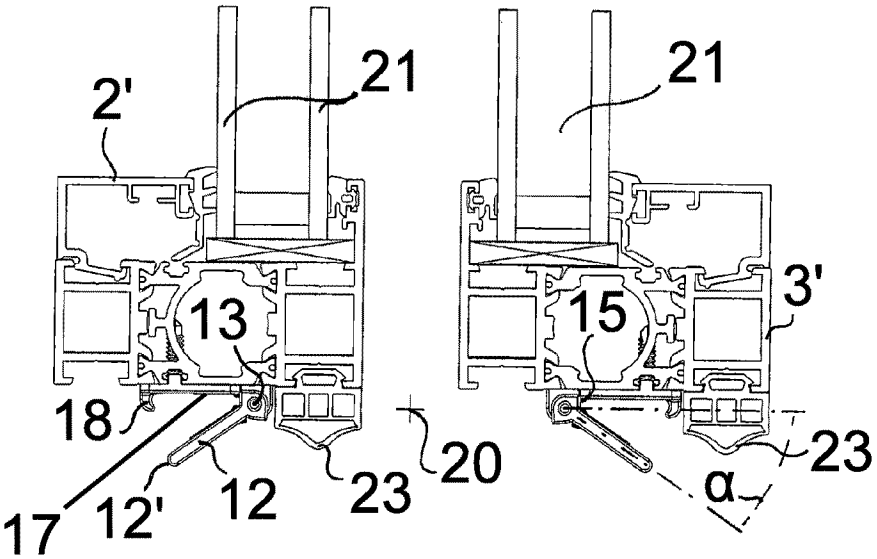
FIG. 5 shows a section view of the fixation device of FIG. 4 along section line V-V.
Figure 4:
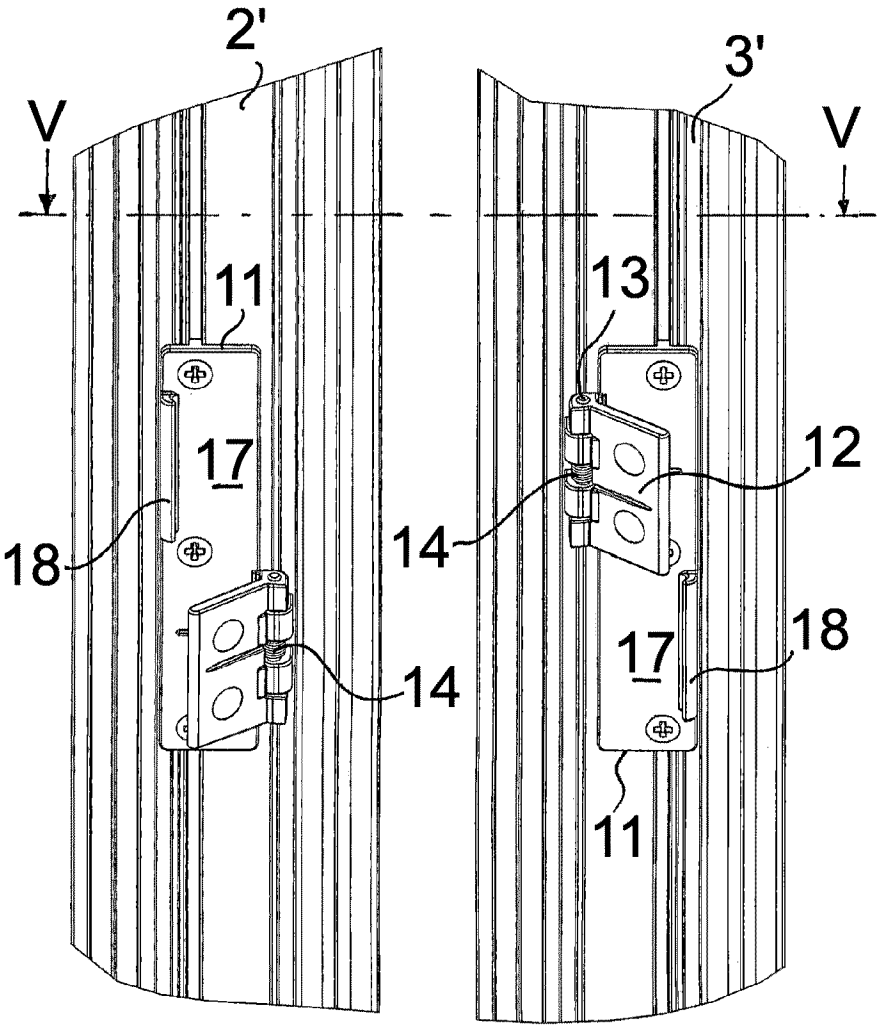
FIG. 4 shows a fixation device in enlarged detail view which is located at position IV in FIG. 3.

With the aid of FIGS. 4 to 11, the fixation devices F according to the invention will be explained which, as needed, are arranged at various positions between pivotable panels 1, 2, 3 as well as between a pivotable panel, here panel 3, and a further construction component, here the outer frame 4. The fixation device F (see FIGS. 8, 9, 11) is comprised in the illustrated embodiment of two fitting parts 11 which here are screwed to the narrow sides of the frame sections 2' and 3'. When looking first at the top half of each fitting part 11, the right fitting part 11 comprises a fixation projection 12 embodied as a tab that is pivotable with a first end about a fixation axis 13 and is pretensioned here by means of a spiral spring 14 so that the second end pivots away from the frame section 3'. The maximum opening angle $\alpha$ of the tab 12 relative to the fastening side of the construction component 3' is indicated in FIG. 5 and is limited by stop 15 to an angle between 30° and 40° in this case. The top half of the left fitting part 11 shown in FIG. 4 comprises a guiding surface 17 and a holding element 18 interacting with the fixation projection 12.

FIGS. 4-11 show a particularly preferred embodiment in which each fitting part 11 comprises a fixation projection 12 as well as a guiding surface 17 and a holding element 18. Therefore, in FIGS. 5, 7, 9, and 11 (sectional plan views) identical elements can be seen on both construction components. The fitting parts 11 can thus be advantageously embodied identically. In their inverted arrangement relative to each other, they secure the construction components relative to each other when closing the construction components but also center a gap that is located between the construction components; this gap is caused by the supporting and guiding fittings 5, 6 and the pivot axis of the construction components defined by the fittings 5, 6 and indicated in the Figures by cross 20.

Figure 7:
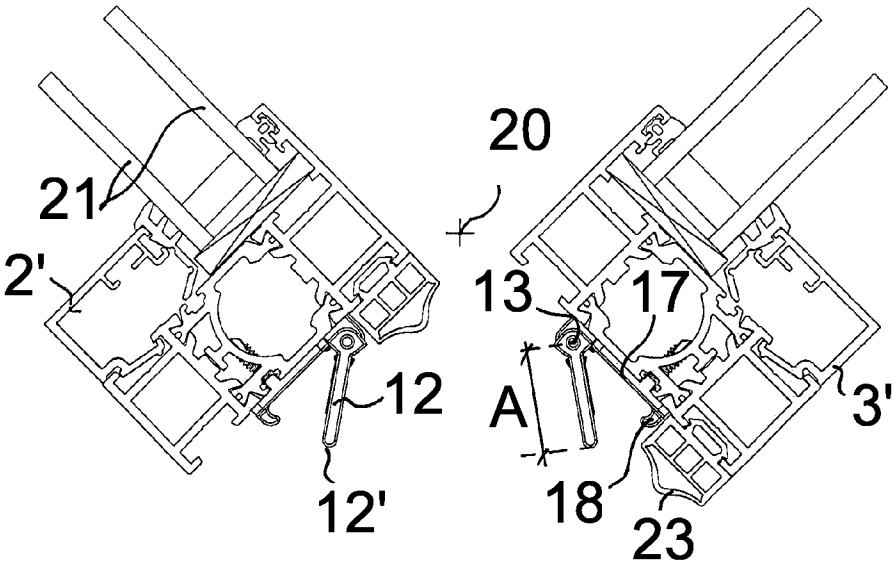
FIG. 7 shows a section view of the fixation device of FIG. 6 along section line VII-VII.
Figure 6:
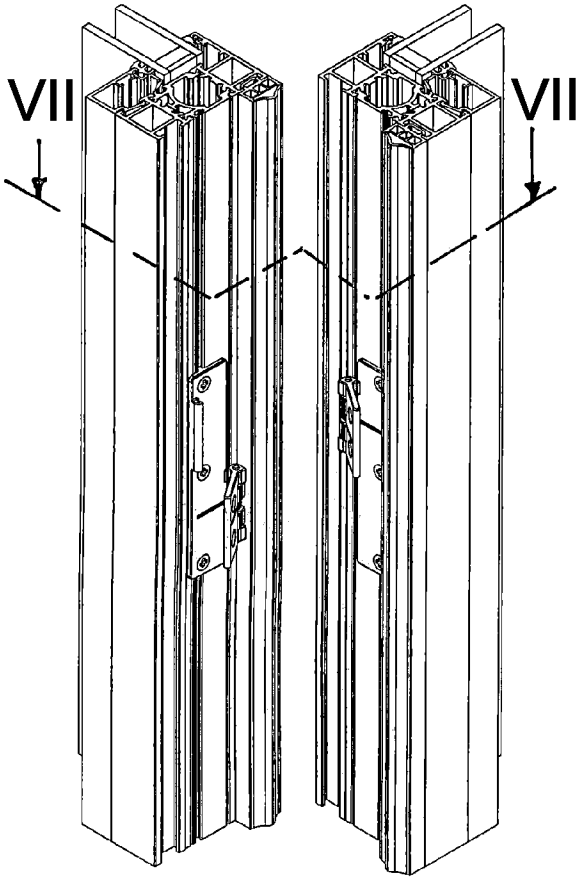
FIG. 6 is an illustration corresponding to FIG. 4 of the fixation device at the position VI of FIG. 2.
Figure 9:
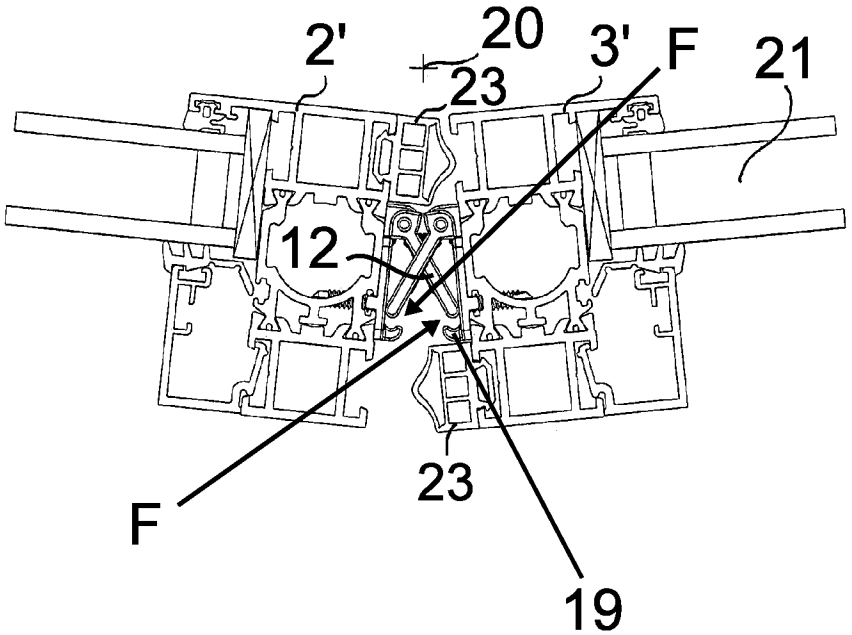
FIG. 9 shows a section view along section IX-IX of FIG. 8.
Figure 8:
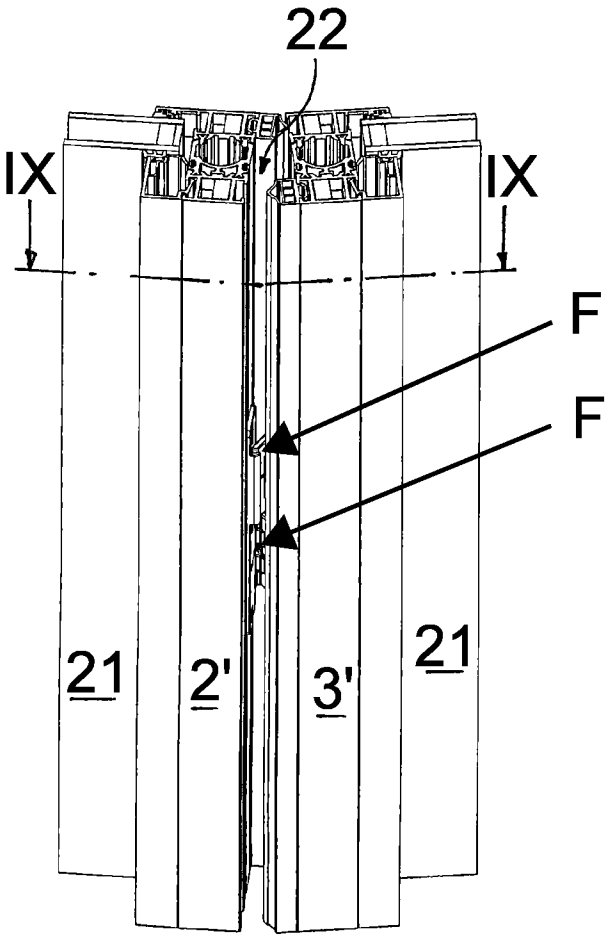
FIG. 8 shows the elements of FIG. 6 in an almost closed position.

In FIGS. 4 through 11 (provided in pairs, respectively), the course of movement upon pivoting the narrow sides of the frame sections 2', 3' toward each other until the folding device is completely closed (FIGS. 10 and 11) is illustrated. In this context, the panels 2, 3 with their frame sections 2', 3' supporting glass panes 21 pivot about pivot axis 20 (or point of rotation 20) so that the fitting parts 11 move toward each other (FIGS. 6, 7). In FIGS. 8, 9, a position is reached in which the tabs 12 with their free ends 12' facing away from the fixation axis 13 come into contact with the guiding surface 17 of the respective oppositely positioned fitting part 11. Upon further pivoting of the panels 2, 3 (FIGS. 10, 11), the free ends 12' of the tabs 12 glide along the guiding surfaces 17 so that the tabs 12 are folded inward in a direction against their pretension. In this situation, the free ends 12' of the tabs 12 engage the holding elements 18 embodied as a depression and catch therein. This is realized in a particularly simple way without unnecessary friction in that the depression of the holding element 18 is embodied with a radius that is preferably corresponding to the configuration of the free end 12' of the tab 12 and significantly smaller than the pivot radius of the tab 12; the pivot radius corresponds to the spacing A of free end 12' relative to the fixation axis 13 (see FIG. 7).

Figure 11:
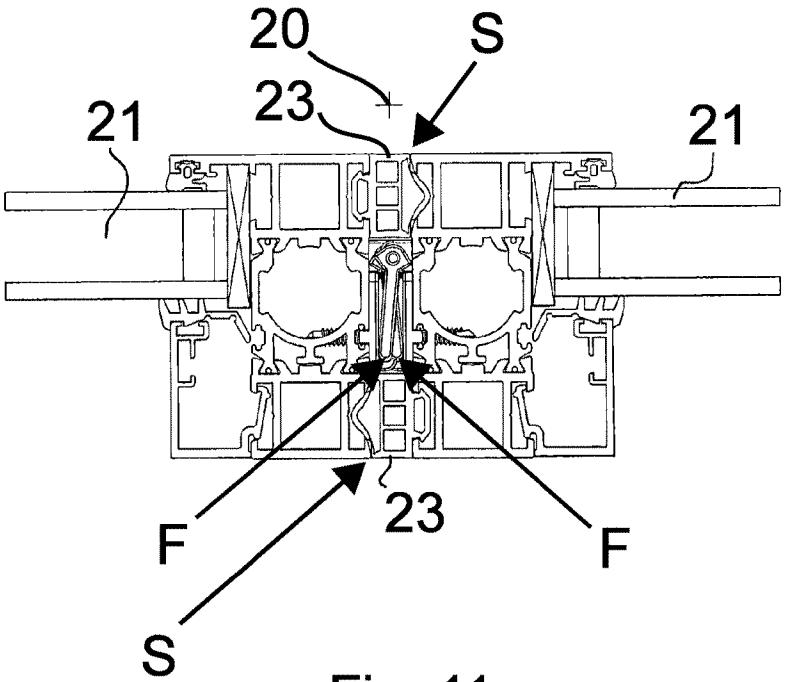
FIG. 11 is a section view along section line XI-XI of FIG. 10.
Figure 10:
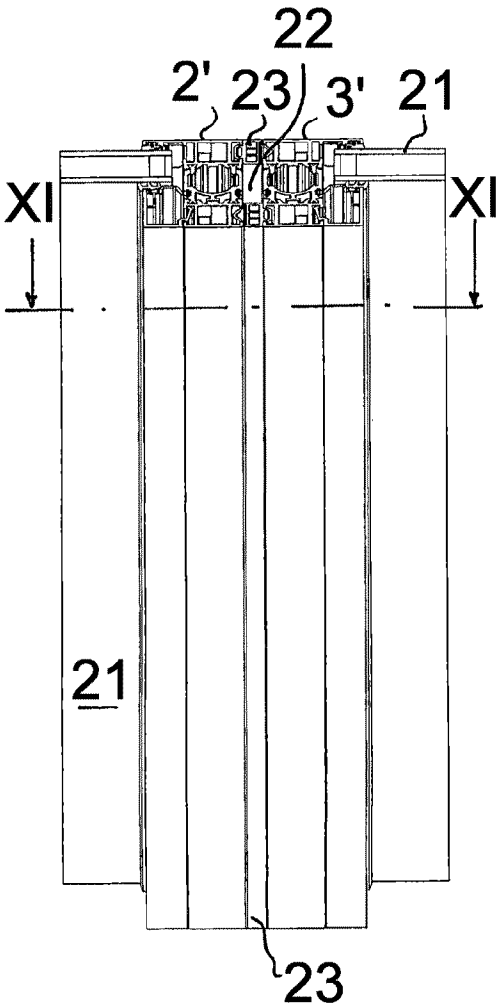
FIG. 10 is an enlarged detail view of the position X of FIG. 1.

FIGS. 10 and 11 illustrate also that the fixation device F according to the invention enables a configuration in which the fixation device F can be completely arranged within a gap 22 between two closed neighboring panels 2, 3. On both sides, externally and internally, the gap 22 can be closed by seals S provided with continuous sealing lips 23 which is advantageous for seal tightness relative to wind, for visual appearance, and for protection against burglary.

With the illustrated fixation devices, the folding device between its panels 1, 2, 3 is self-centering but variable as regards clearance. Accordingly, the fixation devices can be used individually for different sizes of clearance. Each fitting part 11 of the fixation device, as illustrated, can be comprised of only four parts, i.e., the guiding surface 17 with integrally formed holding element 18, the fixation projection 12, the spring 14, and a pin 10 forming the fixation axis 13.

When, for example, for cleaning the exterior surfaces, it is required to separate the panels 2, 3 from each other, it is only necessary to release the fittings 5, 6 at the top and bottom. In case of the fixation devices this is not necessary because they are not fixedly connected to each other but automatically separate from each other when opening the panels 2, 3. By a variable number of employed fixation devices, it is also possible to fulfill different wind load specifications even for tall and slim panels. The practical benefit of such fixation devices is thus significant and so is the visual benefit, in particular in case of large glass surface areas and slim profiled sections.

The specification incorporates by reference the entire disclosure of German priority document 10 2016 125 655.2 having a filing date of Dec. 23, 2016.

While specific embodiments of the invention have been shown and described in detail to illustrate the inventive principles, it will be understood that the invention may be embodied otherwise without departing from such principles.

What is claimed is:

1. A fixation device for limiting a gap between a narrow side of a first construction component and a corresponding side of a second construction component relative to which the first construction component is movable, the fixation device comprising:

a first fitting part configured to be attached to the narrow side of the first construction component;

a second fitting part configured to be attached to the corresponding side of the second construction component;

wherein at least the first fitting part comprises a first fixation projection comprising a first end and an opposed second end, wherein the first end is pivotably supported at a fixation axis that is fixed relative to the first construction component and wherein the first fixation projection is pretensioned by a pretensioning force such that the second end, facing away from the fixation axis, is pivoted away from the first construction component, and the first fixation projection is positioned at an opening angle of less than 90° relative to the narrow side of the first construction component in an open position of the first and second construction parts;

wherein the second fitting part comprises a guiding surface and a holding element;

wherein the first fixation projection and the guiding surface are configured to interact with each other such that, when the first and second construction parts are moved toward each other, the second end of the first fixation projection glides along the guiding surface toward the holding element and is forced against the pretensioning force toward the narrow side of the first construction component so that the opening angle decreases, wherein the second end of the first fixation projection catches in the holding element.

2. The fixation device according to claim 1, wherein the holding element is a depression.

3. The fixation device according to claim 2, wherein the depression is of a rounded configuration with a radius that is smaller than a spacing of the second end of the first fixation projection from the fixation axis.

4. The fixation device according to claim 1, wherein the first fitting part comprises a stop limiting a pivoting action of the fixation projection about the fixation axis in a direction of the pretensioning force and defining the opening angle in the open position.

5. The fixation device according to claim 1, wherein the second fitting part comprises a second fixation projection and the first fitting part comprises a holding element, wherein the second fixation projection and the holding element of the first fitting part, respectively, the first fixation projection and the holding element of the second fitting part are arranged relative to each other such that, when the first and second fitting parts are completely moved toward each other, the gap remaining between the narrow side of the first construction component and the corresponding side of the second construction component is centered between the narrow side of the first construction component and the corresponding side of the second construction component.

6. The fixation device according to claim 5, wherein the first and second fitting parts have an identical structure.

7. A folding device comprising interconnected a real construction components connected to one another in a row and embodied as panels, wherein the panels, when opening the folding device, can be folded against each other, wherein each panel is connected to a neighboring panel by top and bottom supporting and guiding fittings arranged at the panels, wherein between the top and bottom supporting and guiding fittings at least one fixation device according to claim 1 is arranged.

8. The folding device according to claim 7, wherein a narrow side of the panels is formed by a frame section and wherein the at least one fixation device, when the folding device is closed, is arranged completely within a gap formed between the frame sections of two neighboring panels.

9. The folding device according to claim 7, wherein frame sections of neighboring panels comprise seals on an inner side and an outer side of the folding device, wherein the seals have a longitudinal extension and are continuous in the longitudinal extension, wherein between the seals the at least one fixation device is arranged between the neighboring panels.

* * * * *